US010156414B2

(12) United States Patent
Fumia et al.

(10) Patent No.: US 10,156,414 B2
(45) Date of Patent: Dec. 18, 2018

(54) ACCOMMODATING FIREARM BUSHING

(71) Applicant: American Classic Arms, LLC, Wayland, NY (US)

(72) Inventors: David Theodore Fumia, Rochester, NY (US); Ronald Herman Kohlstaedt, Wayland, NY (US)

(73) Assignee: American Classic Arms, LLC, Wayland, NY (US)

( * ) Notice: Subject to any disclaimer, the term of this patent is extended or adjusted under 35 U.S.C. 154(b) by 337 days.

(21) Appl. No.: 14/936,182

(22) Filed: Nov. 9, 2015

(65) Prior Publication Data

US 2017/0131056 A1 May 11, 2017

(51) Int. Cl.
*F41A 25/22* (2006.01)
*F41A 21/48* (2006.01)

(52) U.S. Cl.
CPC ..... *F41A 25/22* (2013.01); *F41A 21/488* (2013.01)

(58) Field of Classification Search
CPC ..... F41A 25/22; F41A 21/488
USPC ..... 89/125
See application file for complete search history.

(56) References Cited

U.S. PATENT DOCUMENTS 984,519 A * 2/1911 Browning ..... F41A 17/38 42/25
1,031,279 A * 7/1912 Maxim ..... F41A 21/08 89/126
2,041,015 A * 5/1936 Umberto ..... F41A 19/21 42/17
2,489,816 A * 11/1949 Reilly ..... F41A 25/22 42/75.01
3,158,064 A * 11/1964 Charron ..... F41A 21/00 89/163
3,411,406 A * 11/1968 Pachmayr ..... F41A 25/22 89/196
3,411,408 A * 11/1968 Pachmayr ..... F41A 25/22 89/196
3,564,967 A * 2/1971 La Violette ..... F41A 25/22 89/163
3,731,590 A * 5/1973 Zimmerman, Jr. ..... F41A 5/04 89/163
3,975,982 A * 8/1976 Terstegge ..... F41A 3/64 89/163
4,031,808 A * 6/1977 Raville ..... F41A 3/86 89/163
4,178,833 A * 12/1979 Miller ..... F41A 25/22 89/163
4,228,605 A * 10/1980 Chacornac ..... F41A 21/08 42/106
4,837,962 A * 6/1989 Longerot ..... F41A 21/40 42/90
4,875,402 A * 10/1989 Metz ..... F41A 25/02 89/42.01

(Continued)

*Primary Examiner* — Michelle Clement
(74) *Attorney, Agent, or Firm* — Brian B. Shaw, Esq.; Alfred Y. Chu, Esq.; Harter Secrest & Emery LLP

(57) ABSTRACT

A barrel bushing and retained bias assembly are provided for engaging a barrel of a firearm to accommodate relative longitudinal movement of the barrel bushing and the barrel. The barrel bushing includes a retaining channel for retaining the bias assembly, such that a portion of the bias assembly extends into a bore of the barrel bushing to contact and be partly compressed by the outside diameter of the barrel.

24 Claims, 3 Drawing Sheets

(56) References Cited

U.S. PATENT DOCUMENTS 4,887,510 A * 12/1989 Wynn ..... F41A 25/26 89/163
4,901,411 A * 2/1990 Chestnut ..... B25B 13/48 42/108
4,907,362 A * 3/1990 Hobbie ..... F41A 9/55 42/49.02
5,050,480 A * 9/1991 Knight, Jr. ..... F41A 5/06 42/7
5,235,771 A * 8/1993 Sokol ..... F41C 27/06 42/105
5,271,312 A * 12/1993 Lishness ..... F41A 21/484 42/76.01
5,423,242 A * 6/1995 Schuemann ..... F41A 21/28 89/14.3
5,501,135 A * 3/1996 Beretta ..... F41A 21/482 42/75.02
5,654,519 A * 8/1997 Albrecht ..... F41A 25/22 89/163
5,734,120 A * 3/1998 Besselink ..... F41A 3/14 89/163
5,952,602 A * 9/1999 Gussalli Beretta ..... F41A 25/22 42/133
6,026,728 A * 2/2000 Guhring ..... F41A 21/26 89/14.2
6,405,631 B1 * 6/2002 Milek ..... F41A 5/20 42/10
6,718,680 B2 * 4/2004 Roca ..... F41A 9/45 42/14
6,935,063 B1 * 8/2005 Johnson ..... F41A 1/08 42/40
7,389,719 B2 * 6/2008 Curry ..... F41A 25/22 42/14
8,267,003 B1 * 9/2012 Lou ..... F41H 7/042 89/36.08
8,296,987 B1 * 10/2012 Dlubak ..... F41A 21/08 42/75.01
8,584,390 B1 * 11/2013 Fraher ..... F41C 23/10 42/71.02
9,115,954 B1 * 8/2015 Corsi ..... F41C 7/02
2002/0112599 A1 * 8/2002 Sabates ..... A22B 3/02 89/1.14
2004/0200346 A1 * 10/2004 Baumann ..... F41A 25/22 89/14.05
2005/0188578 A1 * 9/2005 Engel ..... F41A 3/18 42/16
2006/0064914 A1 * 3/2006 Greer ..... F41A 11/02 42/77
2006/0162224 A1 * 7/2006 Connal ..... F41A 35/00 42/108
2006/0185508 A1 * 8/2006 Curry ..... F41A 25/22 89/196
2012/0085225 A1 * 4/2012 Vanek ..... F41A 5/06 89/163
2012/0167440 A1 * 7/2012 StPhillips ..... F41A 21/32 42/116
2012/0180358 A1 * 7/2012 Samson ..... F41A 13/12 42/71.01
2012/0291324 A1 * 11/2012 Bandini ..... F41A 5/04 42/14
2012/0291330 A1 * 11/2012 Johnson ..... F41A 11/00 42/108
2013/0180151 A1 * 7/2013 Moore ..... F41C 27/00 42/90
2013/0291420 A1 * 11/2013 Aalto ..... F41A 21/48 42/75.02
2014/0165446 A1 * 6/2014 Rozic ..... F41G 1/02 42/111
2015/0192383 A1 * 7/2015 Shrode ..... F41A 9/71 42/7
2015/0316336 A1 * 11/2015 Lee ..... F41A 3/38 42/16

* cited by examiner

Figure 1
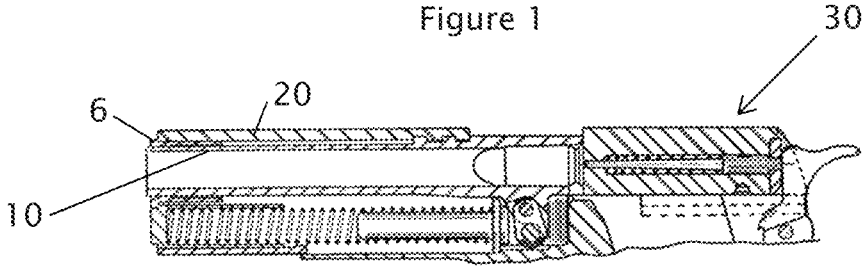
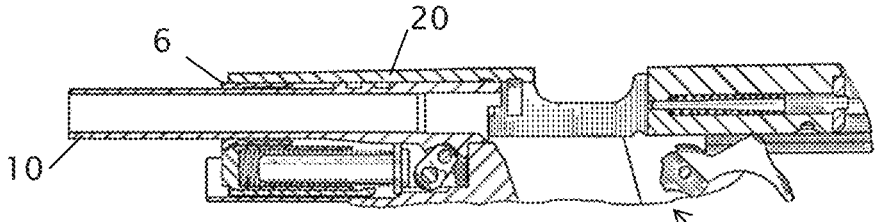
Figure 2

ACCOMMODATING FIREARM BUSHING

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to firearms and particularly to firearms having a slide moveable relative to a barrel and more particularly to a barrel bushing accommodating the relative movement between the barrel and the slide.

Description of Related Art

The value of firearms is often at least partially defined by the ability to provide reliable and accurate operation, and particularly reliable and accurate operation under adverse conditions.

A particular adverse condition includes dust, dirt, grit and foreign matter that can penetrate into the workings of the firearm and cause excessive wear, leading to inaccurate performance or jamming, thereby at least temporarily precluding operation of the firearm.

Prior solutions have focused on the ability to readily dissemble, clean and reassemble the firearm. However, these solutions do not offer a fundamental solution, but rather address the condition after development of the condition.

Therefore, the need exists for an accommodation of foreign matter in a firearm having a barrel and moving slide at least partly interconnected by a bushing, wherein the accommodation increases the duration of operability without increasing the complexity or time for disassembly, cleaning and reassembly.

BRIEF SUMMARY OF THE INVENTION

In one configuration, a bushing assembly is provided for accommodating a gun barrel having an outer diameter. The bushing assembly includes a bushing having a bore sized to receive a length of the barrel, the bushing including a retaining channel exposed to the bore; and a bias assembly seated in retaining channel, the bias assembly having a plurality of discrete contact points separated by interstitial voids.

It is contemplated the discrete contact points of the bias assembly extend from retaining channel a sufficient distance to accommodate variances in an outside diameter of the gun barrel and the discrete contact points of the bias assembly extend from retaining channel a sufficient distance to accommodate variances in an outside diameter of the gun barrel, so as to be partially compressed by an outside surface of the barrel.

A method is provided including disposing a length of a gun barrel within a bore of a barrel bushing, the bore including a retaining channel exposed to the bore; and compressing a bias assembly partly retained within the retaining channel with an outside surface of the gun barrel to define contact between the bias assembly and the barrel.

BRIEF DESCRIPTION OF THE SEVERAL VIEWS OF THE DRAWING(S)

FIG. 1 is a partial cross sectional view of a portion of a representative firearm incorporating a barrel bushing, showing a barrel and slide in a first configuration.

FIG. 2 is a partial cross sectional view of the portion of the representative firearm of FIG. 1, incorporating the barrel bushing, and showing the barrel and the slide in a second configuration.

DETAILED DESCRIPTION OF THE INVENTION

Figure 4:
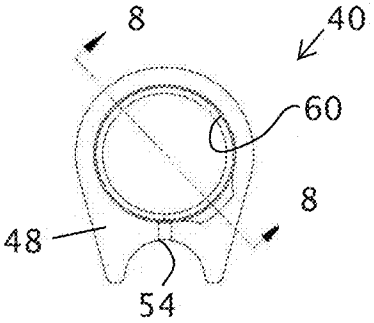
FIG. 4 is a rear elevational view of the barrel bushing of FIG. 3.
Figure 3:
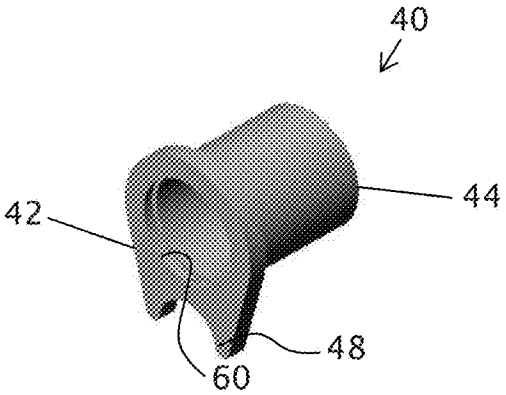
FIG. 3 is a perspective rendering of the present barrel bushing.
Figure 5:
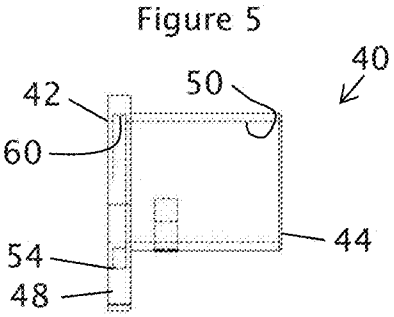
FIG. 5 is a side elevational view of the barrel bushing of FIG. 3.
Figure 8:
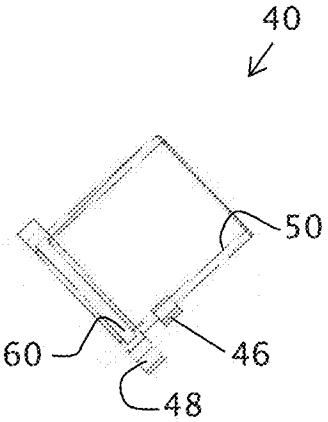
FIG. 8 is a cross sectional view taken along lines 8-8 of FIG. 7.
Figure 7:
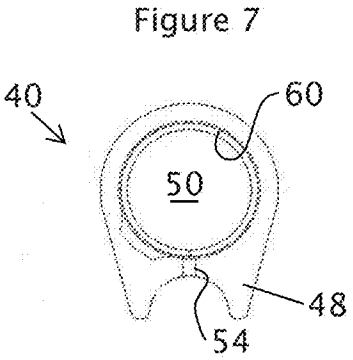
FIG. 7 is a front elevational view of the barrel bushing of FIG. 3.
Figure 6:
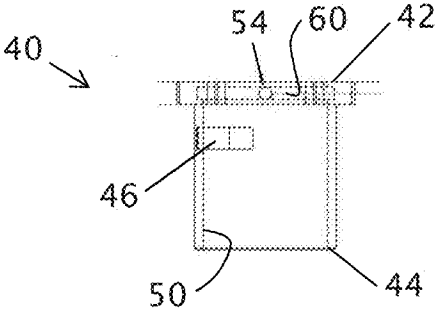
FIG. 6 is a bottom plan view of the barrel bushing of FIG. 3.
Figure 9:
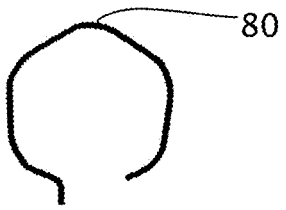
FIG. 9 is a plan view of a bias assembly prior to seating in a retaining channel.

Referring to FIGS. 1 and 2, in one configuration, a bushing 6 is operably located between a barrel 10 and a slide 20 in a firearm 30, wherein the barrel and the slide experience relative motion during intended use. Thus, the barrel bushing accommodates relative motion between the barrel 10 and the slide 20.

The term firearm 30 includes guns, such as rifles, pistols, shotguns, handguns, muzzle loaders, machine guns and cannons, wherein the motive energy can be from chemical or mechanical storage and the firearm includes a barrel and a slide. It is understood the firearm 30 includes a trigger and firing mechanism as known in the art.

For purposes of illustration, the present assembly is set forth in terms of a M1911, a single-action, semi-automatic, magazine-fed, recoil-operated pistol. However, it is understood the barrel bushing can be employed in other firearms.

The barrel 10 has a nominal outside diameter, wherein the actual diameter may be within certain tolerances. For purposes of description, the barrel 10 defines a longitudinal axis extending along the length of the barrel (also the direction of projectile travel through the barrel), with a radial direction extending perpendicular to the longitudinal axis.

A bushing, such as a barrel bushing 40, of the present system is shown in FIGS. 3-8 and 10. The barrel bushing 40 includes a muzzle end 42, a breech end 44, a retaining tab 46 and a vertical lug 48. The retaining tab 46 is sized to engage the slide 20 in a manner as known in the art.

The barrel bushing 40 includes bore 50 extending along the longitudinal axis from the muzzle end 42 to the breech end 44, wherein the bore is sized to receive a length of the barrel 10. In one configuration, the bore 50 is sized to slideably receive substantially the length of the barrel. However, as set forth above, the outside diameter of the barrel 10 may have slight variations within manufacturing or design tolerances. The bore 50 can have different diameters along the longitudinal axis within manufacturing or design tolerances as well as intended diameter changes. For example, the muzzle end 42 of the bore 50 can include an increased diameter as compared to an adjacent section of the bore.

In one configuration, a diameter of the bore 50 is 100% to 125% the outside diameter of the barrel 10, with the diameter being between approximately 101% to approximately 115% in a further configuration. It is contemplated the bore 50 can be sufficiently oversized relative to the outside diameter of the 10 barrel to assist in tolerating the presence of foreign matter, grit, without reducing the functionality of the barrel bushing 40.

As seen in FIGS. 3-8, the bore 50 includes a retaining channel 60. In one configuration, the retaining channel 60 lies in a plane perpendicular to the longitudinal axis. The retaining channel 60 can extend about substantially the entire circumference of the bore 50. For example, the retaining channel 60 can extend from approximately 60% to 100% of the circumference of the bore 50. However, it is understood the retaining channel 60 can be comprised of a plurality of discrete channels or segments, each separated from another by a stop and each extending less than 180 degrees. In one configuration, the retaining channel 60 includes two or three discrete channels such as recesses, sockets or pockets. Thus, in these configurations, the retaining channel 60 can define between approximately 5% to 90% of the circumference of the bore 50. That is, the retaining channel 60 can define three discrete and separate portions, each portion defining less than 25% of the circumference of the bore 50.

The retaining channel 60 can be located proximal to one end of the barrel bushing 40. Referring to FIGS. 3-8, the retaining channel 60 is located adjacent the muzzle end 42 of the barrel bushing 40. However, it is understood the retaining channel 60 can be located at other positions along the barrel bushing 40.

The barrel bushing 40 can further include a radial port 54 extending from an outside surface of the barrel bushing to the retaining channel 60.

The radial port 54 intersects the retaining channel 60, and can in certain configurations define an end of the retaining channel 60. It is contemplated the retaining channel 60 can extend from the radial port 54 substantially about the entire circumference of the bore 50 to a terminal end terminating at the stop. The stop separating the radial port 54 and the end terminal end can be between approximately 0.5% to 20% of the circumference of the bore 50.

A bias assembly 80 is disposed in the retaining channel 60. The bias assembly 80 is sized to be partly retained within the retaining channel 60, wherein a portion of the bias assembly projects into the bore 50.

The amount, or distance, the bias assembly 80 projects into the bore 50 is at least partly determined by the anticipated or designed distance between the outside diameter of the barrel 10 and the bore, including anticipated tolerances of the outside diameter of the barrel.

The portion of the bias assembly 80 projecting from the retaining channel 60 is sized to contact the outside surface of the barrel 10. In one configuration, the retaining channel 60 and the bias assembly 80 are configured such that upon a given radial force on the bias assembly a sufficient portion of the bias assembly remains within the bore 50 to contact the outside surface of the barrel 10 to provide operable engagement of the barrel bushing 40 and the barrel. That is, the retaining channel 60 and the bias assembly 80 are configured such that a sufficient portion of the bias assembly projects into the bore 50 (from approximately 5% to 99%) to contact the barrel 10, while the remaining portion of the bias assembly can be urged to within the retaining channel by contact with the barrel. In certain configurations, at least 5% of the bias assembly 80 remains positioned within the bore 50 upon contact with the barrel 10.

The bias assembly 80 exerts sufficient force on the barrel 10 to retain the relative radial position of the barrel bushing 40 and the barrel. The bias assembly 80 is sufficiently resilient to maintain a force on the barrel 10 during the intended operating duration of the bias assembly. The force is sufficient to maintain the bias assembly 80 as the area of contact between the outside surface of the barrel 10 and the barrel bushing 40. In one configuration, the force from the bias assembly against the barrel 10 is sufficient to maintain the barrel bushing 40 substantially coaxial with the barrel 10.

In one configuration, the bias assembly 80 defines a plurality of contact points with the barrel 10, wherein interstitial voids, gaps or spaces are formed both between the contact points as well as within the bias assembly itself. The gaps are constructed to accommodate anticipated foreign debris and grit which would otherwise foul or jam the movement of the barrel 10 relative to the barrel bushing 40. The retaining channel 60, with the bias assembly 80 seated therein, also includes gaps or voids to accommodate foreign matter.

Thus, the bias assembly 80 can be any of a variety of configurations, including a coil spring, a wire, a bent wire or a zig-zag wire. The bias assembly 80 can be in the form of a relatively rigid wire bent to define a plurality of straight length facets connected by bends, wherein the facets define contacts points or areas with the outside surface of the barrel. In one configuration, at least 3 facets contact the barrel 10 and in a further configuration between four and eight facets contact, with a given configuration having 6 contacting facets. Alternatively, it is anticipated the bias assembly 80 can be formed of polymeric material such as thermosets, thermoplastics, TPE or TPV. The bias assembly 80 can be a coil spring partly retained within the retaining channel 60 or a plurality, such as at least three, buttons or plugs received within the retaining channel, wherein a portion of the bias assembly projects into the bore and is sufficiently compressible to accommodate barrel variations, while sufficiently resilient to generate the necessary force on the barrel 10 to maintain the bias assembly as the area of contact between the barrel bushing 40 and the barrel.

That is, the bias assembly 80 is selected to provide force on the outside surface of the barrel 10 while providing spaced contact points with the barrel. The bias assembly 80 is sufficiently compressible such that a circumference defined by the uncompressed bias assembly can be increased to receive the outside surface of the barrel 10, while sufficiently resilient to maintain the intended alignment, such as coaxial alignment, of the barrel bushing 40 and the barrel.

The bias assembly 80 can be seated or retained within the retaining channel 60 by a variety of mechanisms including friction fit, detents, mechanical engagements, spring force as well as adhesives or bonding. Releasable connections provide the advantage that the bias assembly 80 can be removed from the retaining channel 60 during cleaning of the firearm 10, thereby allowing foreign material to be cleaned from the system.

By relatively oversizing the bore 50 of the barrel bushing 40 or at least a portion of the bore and using the bias assembly 80 to (i) define the contact with the barrel 10 and (ii) accommodate the increased distance between the outside diameter of the barrel and the bore of the barrel bushing, the present construction can reduce jamming of the barrel relative to the bushing from grit and foreign matter. That is, the increased spacing between the bore 50 of the barrel bushing 40 and the barrel 10 reduces the accumulation and retention of foreign material between barrel bushing and the barrel, particularly as the points of the contact between the bias assembly 80 and the outside of the barrel tend to scrub or dislodge such grit or foreign material and is thus believed to reduce jamming.

In one configuration, the vertical lug 48 has a longitudinal and radial dimension sized to accommodate the retaining channel 60. The vertical lug 48 has sufficient longitudinal dimension to receive the longitudinal dimension of the retaining channel 60 and sufficient radial dimension to accommodate the radial dimension of the retaining channel, while having sufficient remaining material to provide the necessary structural support and rigidity to function in the intended manner.

That is, in contrast prior designs, the lug 48 has a dimension along the longitudinal axis of the barrel bushing 40 between approximately 0.08 to 0.13 inches, with a satisfactory longitudinal dimension of approximately 0.112 inches. The retaining channel 60 in this configuration has an axial dimension of approximately 0.063 inches and a radial depth of approximately 0.050 and 0.1 inches, with a satisfactory depth of the retaining channel being approximately 0.075 inches. That is, in one configuration, the retaining channel 60 has a diameter between approximately 0.6 and 0.75 inches, with a satisfactory diameter being approximately 0.675 inches, relative to a bore diameter between approximately 0.55 and 0.67 inches with a corresponding satisfactory bore diameter being approximately 0.61 inches. The retaining channel 60 can have a diameter between approximately 5% to 15% greater than the diameter of the bore 50, with a satisfactory diameter being approximately 8% to 12% larger.

In one configuration, the barrel bushing 40 has a length between approximately 0.5 inches to 1.2 inches, with a satisfactory length of approximately 0.85 inches. An outside diameter of the barrel bushing 40, excluding the vertical lug 48, can be between approximately 0.6 inches to approximately 0.8 inches with a satisfactory outside diameter of approximately 0.7 inches.

It is understood the satisfactory relative sizes may be dictated by the size of the outside diameter of the barrel 10, the configuration of the bias assembly 80 and the intended operating environment of the firearm 30.

The location of the retaining channel 60 within the longitudinal dimension of the lug 48 provides for a wall thickness of approximately 0.025 inches defining the longitudinal dimension.

Thus, the amount or dimension of the uncompressed bias assembly 80 that extends into the bore 50 to contact the outside diameter of the barrel 10 is sufficient to be compressed by the outside surface of the barrel while maintaining the defined contact between the barrel bushing 40 and the barrel. At least a portion of the bias assembly 80 remains in an annulus between the bore 50 and the outside surface of the barrel 10 upon the barrel being received within the bore, such that the portion of the bias assembly defines the area of contact between the barrel bushing 40 and barrel, while exerting the centering force on the barrel.

It is understood, the bore 50 of the barrel bushing 40, the retaining channel 60 and the bias assembly 80 can be sized to maintain match fit tolerances.

While the bias assembly 80 has been set forth as defining the areas of contact between the barrel 10 and the barrel bushing 40 at the muzzle end 42 of the bushing, it is understood the remainder of the bore 50 does not contact the outside surface of the barrel. The bias assembly 80 thus defines the area of contact between the barrel bushing 40 and the barrel 10. The longitudinal dimension of the barrel bushing 40 is selected to provide stability of the contact between the bias assembly 80 and the barrel 10. That is, the length of the barrel bushing 40 reduces the torque or twisting of the contact between the bias assembly 80 and the barrel 10. By reducing the twisting of the contact between the barrel bushing (via the bias assembly 80) and the barrel 10, movement of the barrel bushing relative to the barrel remains consistent. Thus, the area of contact between the barrel bushing 40 and the barrel 10 is defined by the bias assembly 80, wherein the remaining portion of the barrel bushing is free of contact with the barrel.

In the assembly of one configuration, the barrel bushing 40 is operably engaged with the barrel 10 by disposing a length of the barrel within the bushing, such that the retaining channel 60 confronts the outside surface of the barrel. The bias assembly 80 is introduced through the radial port 54 to pass into the retaining channel 60. The bias assembly 80 is continued to be passed through the radial port 54 to the retaining channel 60 to be fully disposed within the retaining channel. As a first end of the bias assembly 80 contacts the terminal end of the retaining channel 60 and a second end of the bias assembly passes from the radial port, the bias assembly is effectively captured within the retaining channel. That is, as the radial port 54 is substantially perpendicular to the adjacent portion of the retaining channel 60, the bias assembly 80 is unable to pass from the retaining channel to the radial port.

Figure 10:
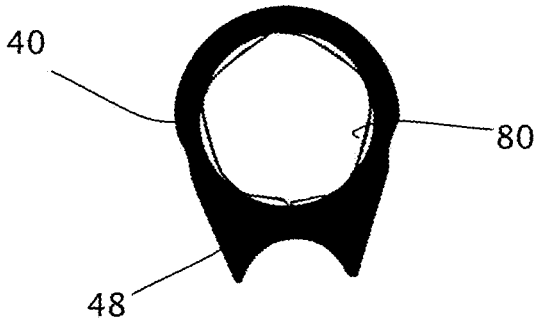
FIG. 10 is a front view of a barrel bushing having a bias assembly in the retaining channel.

Alternatively, in assembly of the barrel bushing 40 and the barrel 10 shown in FIG. 10, the bias assembly 80 can be operably located within the retaining channel 60, prior to the barrel bushing receiving the barrel.

To unseat or remove the bias assembly 80 from the retaining channel 60, a probe can be passed through the radial port 54 to locally urge the bias assembly from the retaining channel.

Because of the ability to employ a variety of configurations of the bias assembly 80, the bias assembly and/or barrel bushing 40 can be formed of a variety of materials including, but not limited to aluminum, anodized aluminum, brass or alloys as well as steels including stainless steel.

Thus, the present disclosure provides the firearm 30 having the slide 20 and the barrel 10, wherein the slide moves relative to the barrel. The firearm 30 includes the barrel bushing 40 mechanically intermediate or between the slide 20 and the barrel 10 for accommodating the relative motion, wherein the area of contact between the barrel bushing and the barrel is solely defined by the bias assembly 80 retained within the retaining channel 60 of the barrel bushing.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A bushing assembly for accommodating a gun barrel having an outer diameter, the bushing assembly comprising:

(a) a bushing having a bore sized to receive a length of the barrel, the bushing including a retaining channel exposed to the bore, the bushing includes a radial port intersecting the retaining channel; and (b) a bias assembly seated in the retaining channel, the bias assembly having a plurality of discrete contact points separated by interstitial voids.

2. The bushing assembly of claim 1, wherein the bias assembly is one of a coil spring, a bent wire and a formed wire.

3. The bushing assembly of claim 1, wherein the bias assembly comprises a corresponding plurality of buttons.

4. The bushing assembly of claim 1, wherein the retaining channel extends about a circumference of the bore.

5. The bushing assembly of claim 1, wherein the discrete contact points of the bias assembly extend from the retaining channel a sufficient distance to accommodate variances in an outside diameter of the gun barrel.

6. The bushing assembly of claim 1, wherein the bore is oversized relative to the outer diameter and the resilient bias assembly sufficiently extends into the bore to accommodate the oversized bore.

7. The bushing assembly of claim 1, wherein the bushing is a barrel bushing.

8. The bushing assembly of claim 1, wherein the number of discrete contact points of the bias assembly is sufficient to accommodate foreign particulate matter in the interstitial voids.

9. The bushing assembly of claim 1, further comprising a slide, wherein the bushing contacts the slide and the barrel.

10. The bushing assembly of claim 1, wherein a portion of the bias assembly projects from the retaining channel and is adapted to contact the gun barrel.

11. The bushing assembly of claim 1, wherein the retaining channel includes a plurality of discrete channels.

12. A bushing assembly for accommodating a gun barrel having an outer diameter, the bushing assembly comprising:

(a) a bushing having a bore sized to receive a length of the barrel, the bushing including a retaining channel exposed to the bore;

(b) a bias assembly seated in the retaining channel, the bias assembly having a plurality of discrete contact points separated by interstitial voids, and (c) a radially projecting lug extending along a longitudinal dimension of the bushing, wherein the retaining channel is within the longitudinal dimension of the lug.

13. The bushing assembly of claim 1, wherein the bias assembly is mechanically retained within the retaining channel.

14. The bushing assembly of claim 1, wherein the bias assembly extends into the bore approximately 0.5% to 20% of the diameter of the bore.

15. The bushing assembly of claim 1, wherein the bias assembly defines substantially the entire contact between the barrel bushing and the barrel.

16. A bushing assembly for accommodating a gun barrel having an outer diameter, the bushing assembly comprising:

(a) a bushing having a bore sized to receive a length of the barrel, the bushing including a retaining channel exposed to the bore; and (b) a bias assembly seated in the retaining channel, the bias assembly having a plurality of discrete contact points separated by interstitial voids, wherein the bias assembly defines the entire contact between the barrel bushing and the barrel.

17. The bushing assembly of claim 12, wherein the bias assembly is one of a coil spring, a bent wire and a formed wire.

18. The bushing assembly of claim 12, wherein the discrete contact points of the bias assembly extend from the retaining channel a sufficient distance to accommodate variances in an outside diameter of the gun barrel.

19. The bushing assembly of claim 12, wherein the bore is oversized relative to the outer diameter and the resilient bias assembly sufficiently extends into the bore to accommodate the oversized bore.

20. The bushing assembly of claim 12, wherein a portion of the bias assembly projects from the retaining channel and is adapted to contact the gun barrel.

21. The bushing assembly of claim 16, wherein the bias assembly is one of a coil spring, a bent wire and a formed wire.

22. The bushing assembly of claim 16, wherein the discrete contact points of the bias assembly extend from the retaining channel a sufficient distance to accommodate variances in an outside diameter of the gun barrel.

23. The bushing assembly of claim 16, wherein the bore is oversized relative to the outer diameter and the resilient bias assembly sufficiently extends into the bore to accommodate the oversized bore.

24. The bushing assembly of claim 16, wherein a portion of the bias assembly projects from the retaining channel and is adapted to contact the gun barrel.

* * * * *